US005492171A

United States Patent [19]

Källrot

[11] Patent Number: 5,492,171

[45] Date of Patent: Feb. 20, 1996

[54] PLATE HEAT EXCHANGER, A METHOD OF PRODUCING A PLATE HEAT EXCHANGER AND MEANS FOR PERFORMING THE METHOD

[75] Inventor: Magnus Källrot, Lund, Sweden

[73] Assignee: Alfa Laval Thermal AB, Lund, Sweden

[21] Appl. No.: 75,497

[22] PCT Filed: Dec. 13, 1991

[86] PCT No.: PCT/SE91/00858

§ 371 Date: Jun. 9, 1993

§ 102(e) Date: Jun. 9, 1993

[87] PCT Pub. No.: WO92/11501

PCT Pub. Date: Jul. 9, 1992

[30] Foreign Application Priority Data

Dec. 17, 1990 [SE] Sweden ..... 9004026

[51] Int. Cl.[6] ..... F28F 9/26

[52] U.S. Cl. ..... 165/167; 165/144

[58] Field of Search ..... 165/166, 167, 165/153, 144, 145

[56] References Cited

U.S. PATENT DOCUMENTS

| | | | |
|---|---|---|---|
| 2,617,634 | 11/1952 | Jendrassik | 165/167 |
| 2,623,736 | 12/1952 | Hytte | 165/166 |
| 2,677,531 | 5/1954 | Hock, Sr. et al. | 165/167 |
| 3,106,243 | 10/1963 | Knudsen | 165/167 |
| 3,196,937 | 7/1965 | Jenssen | 165/166 X |
| 3,255,817 | 6/1966 | Davids et al. | 165/167 X |
| 3,759,308 | 9/1973 | Gebauer | 165/167 X |
| 4,274,482 | 6/1981 | Sonoda | 165/166 X |
| 4,303,123 | 12/1981 | Skoog | 165/166 |
| 4,589,480 | 5/1986 | Dahlgren | 165/167 X |
| 4,621,685 | 11/1986 | Nozawa | 165/153 X |
| 4,987,955 | 1/1991 | Bergqvist et al. | 165/167 |

*Primary Examiner*—Leonard R. Leo

*Attorney, Agent, or Firm*—Davis Hoxie; Faithfull & Hapgood

[57] ABSTRACT

A permanently united plate heat exchanger normally comprises a plate package (1) having two end plates (3, 4) and several heat transferring plates (5) which are arranged therebetween. The end plates (3, 4) and the heat transferring plates (5) are permanently united, for instance by brazing, to a plate package the end plates of which have altogether four openings to form inlets and outlets for two heat exchange fluids. Two or more plate packages (1, 2) may be coupled together to form a plate heat exchanger. Preferably, plate packages of this kind are produced which have different numbers of heat transferring plates (5, 8).

14 Claims, 2 Drawing Sheets

Figure 1:
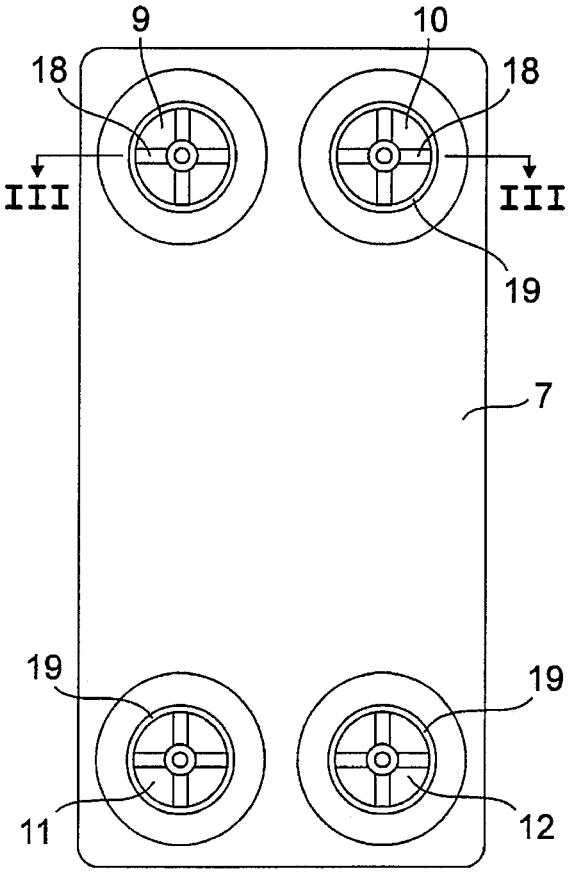

PLATE HEAT EXCHANGER, A METHOD OF PRODUCING A PLATE HEAT EXCHANGER AND MEANS FOR PERFORMING THE METHOD

The present invention relates to a plate heat exchanger for heat exchange between two pressurized fluids, comprising a plate package having two end plates and several thin heat transferring plates arranged therebetween, each of the heat transferring plates having a heat transferring portion provided with spacing means for creation of flow passages between adjacent plates and an edge portion extending therearound, the heat transferring plates further having through ports situated aligned with each other for the forming of four port channels extending through the plate package, two of which port channels communicate only with the flow passages in every second plate interspace, one on each side of the heat transferring portions of the heat transferring plates, and the two other port channels communicate only with the flow passages in the other plate interspaces, one on each side of said heat transferring portions, the end plates and the heat transferring plates being permanently united with adjacent heat transferring plates both along the edge portions of the latter and at several places distributed across their heat transferring portions in a way such that the plate package is thereby kept together against the action of the pressures exerted by the pressurized fluids on the heat transferring plates in the plate interspaces, and at least one of the end plates having openings, which are arranged for through flow of said two fluids and each of which communicates with one port channel. By "end plate" is meant in this connection just a plate situated at one end of the plate package. An end plate can be either as thin as a heat transferring plate or, if considered suitable, be thicker than such a plate. By the expression "permanently united" it is meant here such a connection between the plates in the plate package that the plates should not easily be separable without being destroyed, and that the plates by their mutual connection can take up the pressures of the two heat exchanging fluids in the plate interspaces without requiring a frame or the like to keep the plate package together against the action of these pressures.

A plate heat exchanger of the above-defined kind is f described in WO 88/09473. A plate heat exchanger of this kind is characterized in that it has no frame or other strong means for compressing and keeping together the plates in the plate package. Thus, no such means are required for compressing sealing edge gaskets between the plates, since the permanent connection of the heat transferring plates along their edges serves as edge sealing means between the plates. Further, means for keeping the plates together during operation of the plate heat exchanger are not required since, as mentioned above, the permanent connection between the heat transferring portions of the plates is of a kind such that the heat transferring plates themselves will take up the pressure forces caused by the heat exchanging fluids.

A particular type of plate heat exchangers, having permanently united plates, is constituted by so called brazed plate heat exchangers. These have often rather small heat transferring plates, e.g. 30 cm×10 cm or 60 cm×20 cm, and are produced in a way such that a plate package comprising two end plates and a number of heat transferring plates arranged therebetween inserted into a furnace, in which all the plates are brazed together simultaneously.

A producer of brazed plate heat exchangers produces, in practice, for each plate size a certain number of plate package sizes, i.e. plate packages comprising different numbers of heat transferring plates. Standard size brazed plate packages of this kind may be produced cheaply and in long series. Each plate package has inlets and outlets for two heat exchanging fluids, and usually the plate package is provided with special connecting members at said inlets and outlets already in connection with the brazing operation. The connecting members are brazed either all to one and the same end plate or two to one end plate, for one heat exchange fluid, and two to the other end plate, for the other heat exchange fluid.

Each plate heat exchanger produced in this manner can satisfy in an optimum way only one specific heat transferring need, and by this is meant a certain heat transfer between two heat exchanging fluids flowing at predetermined rates through the plate heat exchanger. A certain number of plate heat exchangers of different sizes can thus satisfy in an optimum way only the same number of specific heat exchange needs, and they can be used for other, e.g. intermediate, heat exchange needs only if these can be changed and thus be adapted to the existing plate heat exchangers. Such an adaptation often means, however, that the process, in which an existing heat exchanger is used, has to be operated with energy losses and/or with an unnecessarily large plate heat exchanger.

In addition to an assortment of plate heat exchangers of standard sizes a plate heat exchanger producer also produces a lot of specially dimensioned and specially designed plate heat exchangers intended for specific heat exchange needs. Plate heat exchangers of this kind are more expensive to produce than plate heat exchangers of standard sizes. To the group specially designed plate heat exchangers belong, among others, plate heat exchangers in which the fluid flow for one reason or another has to be conducted so that one heat exchange fluid gives away or receives heat more than once to or from, respectively, the other heat exchange fluid.

The main object of the present invention is, generally, to make production of plate heat exchangers of the initially defined kind even cheaper than at present. Another object of the present invention is to make possible a reduction of the number of required standard sizes of heat exchangers without reduction of the number of specific heat exchange needs satisfyable in an optimum way by means of such heat exchangers. A further object of the invention is to reduce the need of specially dimensioned and specially designed heat exchangers.

For fulfilment of these objects it is suggested, according to the invention, that a plate heat exchanger of the initially defined kind is made such that it comprises at least one further plate package of substantially the same kind as the first said plate package; that the plate packages are arranged so that two of their end plates with openings for the two heat exchange fluids—one end plate of each plate package—are situated opposite to each other and are so sealingly connected with each other around each of their openings that each of the heat exchanging fluids is allowed to flow from one plate package into the other; that the plate packages are held together by members which are arranged to take up pressure forces caused during operation of the plate heat exchanger by said pressurized fluids in the port channels of the plate packages and striving at separating the plate packages from each other, but which members are insufficient to replace said permanent connection between the plates in each plate package for holding the plates together against the action of the pressurized fluids in the plate interspaces; and that at least one of the other end plates of the plate packages has openings for the through flow of heat exchange fluid. For instance, one of the other end plates may have four openings and the other end plate may have no opening at all, or both of the other end plates may have openings for both inflow and outflow of heat exchange fluid.

A preferred embodiment of the above-defined plate heat exchanger is characterized in that each of the end plates, which are situated opposite to each other and are sealingly connected with each other, has four openings communicating with corresponding four openings in the other end plate. Hereby, the flow passages through every second plate interspace in one of the plate packages will be coupled in parallel with the flow passages through every second plate interspace in the other plate package, and the flow passages in all other plate interspaces will be coupled in parallel with each other.

By the invention it is possible by means of plate packages of only a few different sizes, i.e. plate packages containing heat transferring plates of the same size but of different numbers, to produce finished plate heat exchangers of many different sizes, which will thus satisfy in an optimum way many different heat exchange needs.

A plate heat exchanger made as described above, having two or more plate packages coupled together and containing, as a rule, different numbers of heat transferring plates, forms one aspect of the present invention. Another aspect of the invention is to be found in a method of producing a plate heat exchanger of this kind. A further aspect of the invention, which relates basically to a new system for satisfying many different specific heat exchange needs by means of plate heat exchangers of the initially defined general kind, is to be found in the means necessary for performing said production method. Finally, one aspect of the invention is to be found in a plate package, which is designed in a particular way and which alone or together with one or more further plate packages may be included in a plate heat exchanger.

According to a preferred application of the invention plate packages are to be produced each having not only four but altogether eight openings for heat exchange fluids in their end plates. At these eight openings there should not be brazed connecting members for through flow of heat exchange fluids onto the end plates in connection with the brazing together of the plate package, as is usual for the time being at the existing four openings. Instead, connecting members of this kind should be applied only after—or in connection with—assembling of two or more plate packages, unnecessary openings being covered in one or both of the two outer-most end plates, which are turned away from each other. Of course, a plate heat exchanger comprising only one plate package of this kind may be produced in a corresponding manner.

Within the scope of the invention two prefabricated plate packages may be connected permanently with each other, e.g. in a way such that two of their end plates are brazed together around the openings of the end plates. However, it is preferred according to the invention that special coupling members are arranged to hold the plate packages pressed against each other in a detachable way. An arrangement of this kind not only simplifies the assembling of the plate packages, it also makes possible a later exchange of one of the plate packages should this prove suitable or necessary.

In a preferred embodiment of a plate heat exchanger according to the invention said coupling members may also be arranged to detachably retain at one or two end plates the necessary connecting members, through which the plate heat exchanger is to be connected with in- and outlet conduits for the heat exchanging fluids. The coupling members preferably extend through the openings of the four end plates and through the respective port channels in the plate packages.

Figure 2:
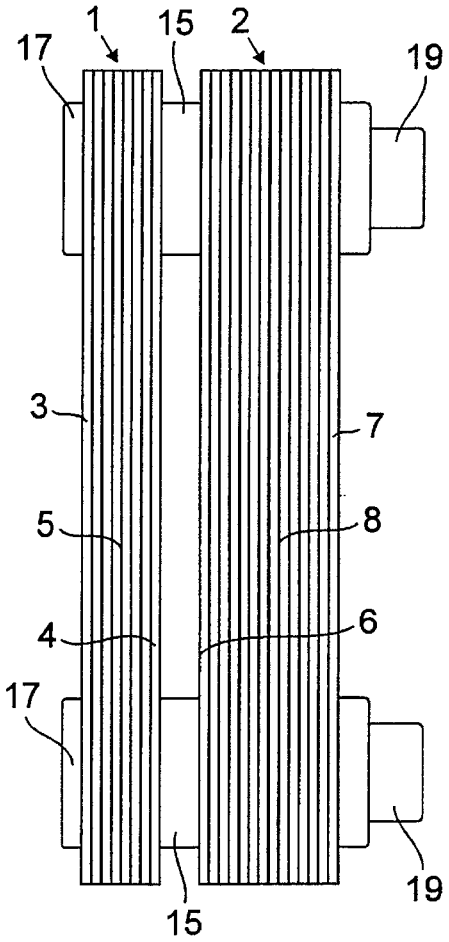
Figure 3:
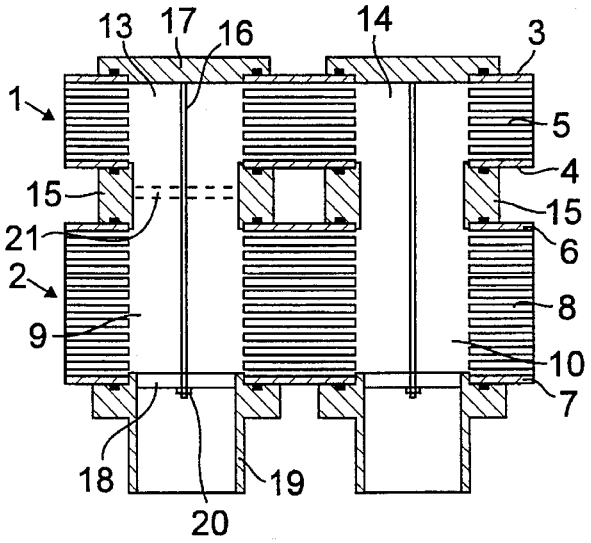
Figure 4:
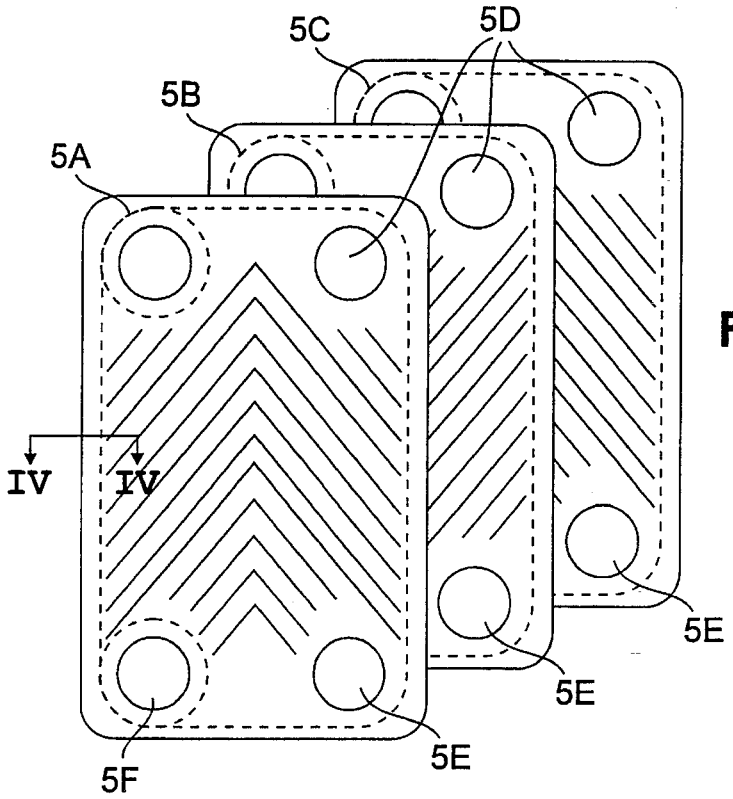
Figure 5:
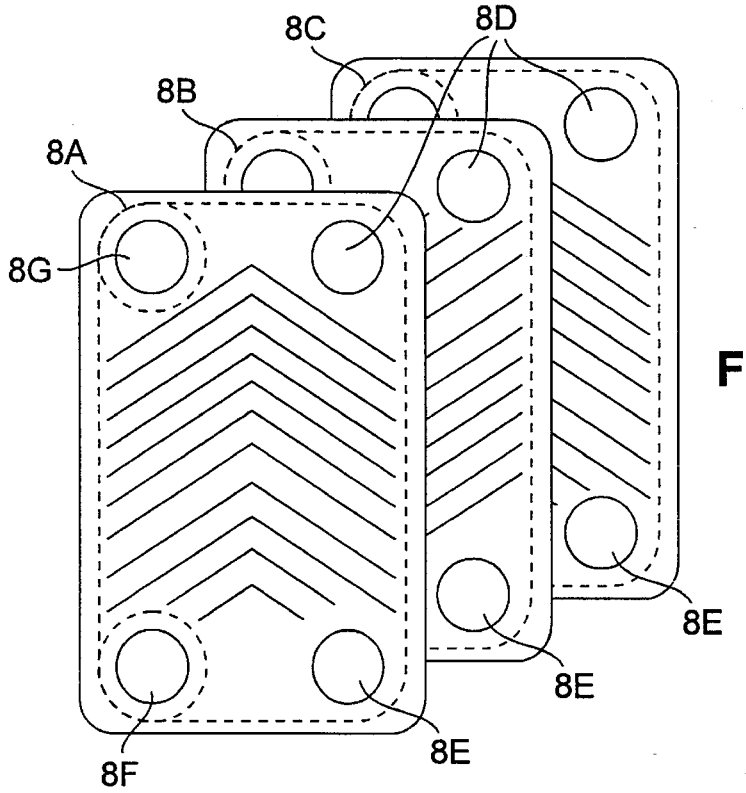

The invention is described in the following with reference to the accompanying drawing, in which FIG. 1–3 show a plate heat exchanger designed according to one embodiment of the invention and seen from the front (FIG. 1), from the side (FIG. 2) and in section (FIG. 3 along the line III—III in FIG. 1, FIG. 4 and 5 show heat transferring plates of different kinds, which may be included in the plate heat exchanger according to FIG. 1–3, and FIG. 6 shows a section along the line VI—VI in FIG. 4 through the edge portions of three heat transferring plates.

The plate heat exchanger in FIG. 1–3 comprises two plate packages 1 and 2. The plate package 1 has two elongated rectangular end plates 3, 4 and a number of somewhat thinner heat transferring plates 5 of the same size as the end plates. The plate package 2 has two end plates 6, 7—as large as the end plates 3, 4—and a number of heat transferring plates 8 of the same size as the heat transferring plates 5. The plate package 2 has more heat transferring plates than the plate package 1.

FIG. 4 shows three of the heat transferring plates in the plate package 1, designated 5*a*, 5*b* and 5*c*, and FIG. 5 shows three of the heat transferring plates in the plate package 2, designated 8*a*, 8*b* and 8*c*. The heat transferring plates in their heat transferring portions have spacing members in the form of corrugations and are oriented relative to each other such that the corrugation ridges of one plate can cross and abut against the corrugation ridges of an adjacent plate. In this manner passages are formed between the heat transferring plates intended to be flowed through by two heat exchanging fluids.

Each end plate of the two plate packages has four through openings in their corner portions and each heat transferring plate has four through ports situated aligned with the openings of the end plates. The ports in the heat transferring plates of the plate package 1 are designated 5*d–f* (see FIG. 4) and form four port channels in the plate package 1. The ports in the plate package 2 are designated 8*d–f* (see FIG. 5) and form in the same manner four port channels through this plate package. In FIG. 1 the port channels in the plate package 2 are designated 9, 10, 11 and 12, whereas in FIG. 3 the only shown upper port channels in the plate package 1 are designated 13 and 14.

As can be seen from FIG. 3, the two upper port channels 13 and 14 in the plate package 1 are situated aligned with the respective upper port channels 9 and 10 in the plate package 2. Also the two lower port channels in the plate package 1 are situated aligned with the corresponding port channels 11 and 12 in the plate package 2.

The end plates 3 and 4 and the heat transferring plates 5 situated therebetween are permanently united with each other by brazing. Brazing joints extend between adjacent heat transferring plates as has been indicated by dotted lines in FIG. 4, and brazing joints are present at each place between adjacent plates, where a corrugation ridge of one plate crosses and abuts against a corrugation ridge of the other plate.

Figure 6:
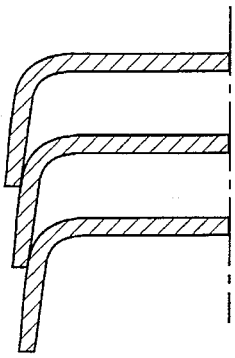

As can be seen from FIG. 4, the plates 5*a* and 5*b* are intended to be brazed together along their edge portions and around their ports 5*d* and 5*e* which are situated opposite to each other, whereas the plates 5*b* and 5*c* are intended to be brazed together along their edge portions and around their ports 5*f* and 5*g*. FIG. 6 shows how the edge portions of adjacent heat transferring plates are bent and overlap each other. Brazing joints are intended to be situated where the plate edge portions contact each other.

In a corresponding manner the heat transferring plates 8 in the plate package 2 are brazed together and with the end plates 6 and 7.

By the described brazing together of the heat transferring plates 8 the port channels 9 and 11 in the plate package 2 —formed by the ports 8*g* and 8*f*, respectively—will communicate with the flow passages in every second plate interspace on each side of the heat transferring portions of the plates but be closed from connection with the flow passages in the other plate interspaces, whereas the port channels 10 and 12 communicate, instead, in a corresponding manner only with the flow passages in said other plate interspaces.

In a corresponding manner, in the plate package 1, the upper port channel 13 and the lower port channel, that is situated aligned with the port channel 11 in the plate package 2, communicate with the flow passages in every second plate interspace, whereas the upper port channel 14 and the other lower port channel, that is situated aligned with the port channel 12 in the plate package 2, communicate with the flow passages in the other plate interspaces in the plate package 1.

As can be seen from FIG. 1–3 the end plates 4 and 6 of the plate packages 1 and 2 are situated opposite to each other, four sleeves 15 being arranged between these end plates coaxially with a respective one of opposite pairs of openings in the end plates 4 and 6. Each sleeve 15 sealingly abuts with its end surfaces against the respective end plates 4 and 6 around the openings therein. Hereby, the port channels of the plate packages will communicate with each other in pairs.

Through every pair of port channels, which are thus situated aligned with and communicate with each other, there extends a rod 16 which at one of its ends supports a covering washer 17 and at its other end is connected with a cross formed oak 18. The covering washer 17 abuts sealingly against the outside of the end plate 3, and the oak 18 is supported internally within and by an annular connecting member 19. The rod 16 extends centrally through the oak 18 and supports at the outside of the oak a nut 20, by means of which the connecting member 19 may be brought to sealing abutment against the outside of the end plate 7 around one of the openings of the latter.

As can also be seen from FIG. 3, the rods 16 form both means for interconnecting and holding together the two plate packages 1 and 2 and means for retaining the covering washers 17 at the end plate 3 and the connecting members 19 at the end plate 7.

Between the port channels 9 and 13, which communicate with each other, there is shown in FIG. 3 by dotted lines a partition 21 which is intended to be arranged at this place only in a particular embodiment of a plate heat exchanger according to the invention.

In the form the plate heat exchanger according to the invention is shown in FIG. 1–3 (without the partition 21) the connecting members 19 are intended to be connected with conduits for two heat exchange fluids, one, of the heat exchange fluids being introducible through the upper-left connecting member and dischargeable through the lower left connecting member (FIG. 1), whereas the other heat exchange fluid may be introduced through the lower right and be discharged through the upper right connecting member. Every second plate interspace in both of the plate packages 1 and 2 then will be flowed through in parallel by one of the heat exchange fluids, while the other plate interspaces in both of the plate packages will be flowed through in parallel by the other heat exchange fluid.

By the invention it is possible to prefabricate in long series plate packages in only a small number of sizes, each plate package having altogether eight openings in their end plates, and by means of plate packages of this kind to produce plate heat exchangers which may satisfy a very large number of heat exchange needs in an optimum way. Thus, only three kinds of plate packages, comprising 10, 20 and 40 plate interspaces, may be used for the production of plate heat exchangers comprising 10, 20, 30, 40, 50, 60, 70, 80, 90, 100 etc. plate interspaces. Even a single plate package may thus form a plate heat exchanger after for instance four of its eight openings in the end plates have been covered by covering washers in the above-described manner.

As can be seen from FIG. 4 and 5 the heat transferring plates 5*a–c* are formed in a different way than the heat transferring plates 8*a–c*. The corrugation patterns in the heat transferring portions of the plates are thus different. As is obvious to a man skilled in the art this means that a plate package comprising a certain number of plates of the kind 5*a–c* has a smaller so called thermal length than a plate package comprising the same number of plates of the kind 8*a–c*. A plate heat exchanger according to the invention may have either plate packages with only one kind of plate interspaces or plate packages with different kinds of plate interspaces.

If desired, a partition 21 can be arranged between two plate packages (FIG. 3) in one or more of the sleeves 15. A partition 21 of this kind may be supported either by the relevant sleeve 15 or by the rod 16 extending therethrough. In an arrangement of only one partition 21, as shown in FIG. 3, the heat exchange fluid entering the port channel 9 through the upper left connecting member 19 (FIG. 1) is first conducted through every second plate interspace in the plate package 2 to the lower left port channel 11 (FIG. 1) and from there through the lower left port channel in the plate package 1 (not shown) and through every second plate interspace in this plate package up to the port channel 13 (FIG. 3). In order that the heat exchange fluid should be able to leave the heat exchanger the cover washer 17 closing the opening of the end plate 3 opposite to the port channel 13 in this case has to be exchanged for a connecting member 19. Further, the lower left connecting member 19 opposite to the port channel 11 has to be exchanged for a covering washer 17.

If a partition 21 is arranged between the port channel 12 in the plate package 2 and the aligned port channel in the plate package 1, the upper right connecting member 19 (FIG. 1) has to be exchanged for a covering washer 17, and the lower covering washer 17 in the end plate 3, which is situated aligned with the port channel 12, has to be exchanged for a connecting member 19.

It shall be noticed that the rods 16 in a plate heat exchanger of the above kind need not take up forces caused by the pressures of the heat exchange fluids in the various plate interspaces. Only forces caused by the pressures of the fluids against the connecting members 19 and the covering washers 17 have to be taken up by the rods 16.

I claim:

1. Plate heat exchanger for heat exchange between two pressurized fluids, comprising a first plate package (2) having two end plates (6, 7) and several thin heat transferring plates (8) arranged therebetween, each of the heat transferring plates having a heat transferring portion provided with spacing means to create flow passages between adjacent plates and an edge portion extending therearound, the heat transferring plates (8) further having through ports aligned with each other to form four port channels (9–12) which extend through the plate package, two of which port channels (9, 11) communicate only with the flow passages in every second plate interspace, one on each side of the heat transferring portions of the heat transferring plates, and the other two port channels (10, 12) communicate only with the flow passages in the other plate interspaces, one on each side of said heat transferring portions, the end plates (6, 7) and the heat transferring plates (8) being permanently connected with adjacent heat transferring plates both along the edge portions of the heat transferring plates and at several places distributed across their heat transferring portions in a way such that the plate package thereby is kept together against pressures exerted by the pressurized fluids on the heat transferring plates in the plate interspaces, and at least one end plate having openings, which are arranged for through flow of said two fluids and each of which communicates with one port channel, characterized in that the plate heat exchanger comprises at least one further plate package (1) of substantially the structure defined for said first plate package (2), that the plate packages (1, 2) are arranged in a way such that two (4, 6) of their end plates with openings for the two pressurized fluids—one end plate of each plate package—are situated opposite to each other and are so sealingly connected with each other around each of their openings that each of the heat exchange fluids is allowed to flow from one plate package into the other, that the plate packages are held together by members (16), which are arranged to take up pressure forces caused during operation of the plate heat exchanger by said pressurized fluids in the port channels (9–14) of the plate packages and striving at separating the plate packages from each other, but which members are insufficient to replace said permanent connection between the plates in each plate package for holding the plates together against the action of the pressurized fluids in the plate interspaces, and that at least one (7) of the other end plates (3, 7) of the plate packages has openings for through flow of heat exchange fluid.

2. Plate heat exchanger according to claim 1, characterized in that each of the end plates (4, 6), which are connected with each other, has four openings communicating with corresponding four openings in the other end plate, so that the flow passages through every second plate interspace in one plate package (1) are coupled in parallel with the flow passages through every second plate interspace in the other plate package (2), and the flow passages in all other plate interspaces are coupled in parallel with each other.

3. Plate heat exchanger according to claim 2, characterized in that the heat transferring plates (5*a–c*, 8*a–c*) in the plate packages (1, 2) are so formed that flow resistance for at least one heat exchange fluid is larger in each plate interspace in one plate package than in each plate interspace in the other plate package.

4. Plate heat exchanger according to claim 1, characterized in that one plate package (2) contains more heat transferring plates than the other (1).

5. Plate heat exchanger according to claim 1, characterized in that the two end plates (4, 6) facing each other are permanently united with each other around their openings, for instance by brazing.

6. Plate heat exchanger according to claim 1, characterized by coupling members (16) arranged to detachably hold the plate packages (1, 2) pressed against each other.

7. Plate heat exchanger according to claim 6, characterized in that said coupling members (16) extend through the openings of the end plates (3, 4, 6, 7) and through the port channels (9–14) of the plate packages (1, 2).

8. Plate heat exchanger according to claim 7, characterized in that said coupling members (16) are arranged to hold connecting members (19) for through flow of heat exchange fluids, pressed against the outside of at least one (7) of the two end plates of the plate packages, which are turned away from each other.

9. Plate heat exchanger according to claim 6, characterized in that it comprises at least two plate packages (1, 2), the end plates (4, 6) of which each has four openings communicating with the respective port channels in the plate packages, and that said coupling members (16) are arranged to detachably hold covering washers (17) or the like pressed against an outside of at least one (3) of the end plates turned away from each other for covering openings therein.

10. Method of producing a plate heat exchanger for heat exchange between two pressurized fluids, comprising a plate package (2) having two end plates (6, 7) and several thin heat transferring plates (8) arranged therebetween and each having a heat transferring portion provided with spacing means for creating flow passages between adjacent plates, and an edge portion extending therearound, the heat transferring plates (8) further having through ports aligned with each other for forming four port channels (9-12) extending through the plate package, two (9, 11) of which port channels communicate only with the flow passages in every second plate interspace, one on each side of the heat transferring portions of the heat transferring plates, and the two other port channels (10, 12) communicate only with the flow passages in the other plate interspaces, one on each side of said heat transferring portions, the end plates (6, 7) and the heat transferring plates (8) being permanently united with adjacent heat transferring plates both along the edge portions of said adjacent heat transferring plates and at several places distributed across their heat transferring portions in a way such that the plate package thereby is kept together against pressures exerted by the pressurized fluids in the plate interspaces, and at least one of said end plates having openings arranged for through flow of said two fluids and communicating each with one port channel, characterized in that:

two end plates (4, 6) of two prefabricated plate packages (1, 2) of the defined structure, one end plate of each plate package, are placed opposite to each other and connected with each other around each of their openings, so that each of the two heat transferring fluids is permitted to flow from one plate package (2) into the other, the plate packages are connected with each other by means of members (16) able to take up pressure forces which during operation of the plate heat exchanger are caused by said pressurized fluids in the port channels (9–14) of the plate packages and striving at separating the plate packages from each other, but which members are insufficient to replace said permanent connection between the plates in each plate package for keeping the plates together against the action of the pressurized fluids in the plate interspaces, and at least one plate package, which has in each of its end plates four openings each communicating with one port channel, is used for the production of the plate heat exchanger.

11. Method according to claim 1, characterized in that the two plate packages (1, 2) are detachably coupled together.

12. Means for performing the method according to claim 10, characterized in that it comprises at least two plate packages (1, 2), each of which has two end plates and several thin heat transferring plates arranged therebetween, the heat transferring plates each having a heat transferring portion, provided with spacing means for the creation of flow passages between adjacent plates, and an edge portion extending therearound, the heat transferring plates further having through ports situated aligned with each other for forming four port channels extending through the plate package, two of which port channels communicate only with the flow passages in every second plate interspace, one on each side of the heat transferring portions of the heat transferring plates, and the two other port channels communicate only with the flow passages in the other plate interspaces, one on each side of said heat transferring portions, the end plates and the heat transferring plates being permanently united with adjacent heat transferring plates both along the edge portions of the latter and at several places distributed across their heat transferring portions, the plate packages (1, 2) have different numbers of heat transferring plates (5, 8), each of the end plates (3, 4, 6, 7) in each of the plate packages has four openings situated opposite to the respective port channels in the plate package, and the openings in the end plates of the one plate package are situated in the same way and at the same distances from each other as the openings in the end plates of the other plate package.

13. Means according to claim 12, characterized in that it also comprises coupling members (16) arranged detachably to hold together two plate packages (1, 2), which are arranged with two of their end plates (4, 6)—one end plate of each plate package—opposite to each other.

14. Means according to claim 13, characterized in that it also comprises connecting members (19) for the through flow of heat exchange fluids, said connecting members (19) being arranged by means of said coupling members (16) to be held pressed against the outside of at least one of those end plates of the two plate packages held together, which are turned away from each other.

* * * * *